US008628274B2

(12) United States Patent
Pollack

(10) Patent No.: US 8,628,274 B2
(45) Date of Patent: Jan. 14, 2014

(54) TENSION LEG CONNECTION SYSTEM AND METHOD

(75) Inventor: Jack Pollack, Houston, TX (US)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 12/673,840

(22) PCT Filed: Aug. 18, 2008

(86) PCT No.: PCT/EP2008/060808
§ 371 (c)(1),
(2), (4) Date: Feb. 17, 2010

(87) PCT Pub. No.: WO2009/024558
PCT Pub. Date: Feb. 26, 2009

(65) Prior Publication Data

US 2011/0052327 A1 Mar. 3, 2011

(30) Foreign Application Priority Data

Aug. 17, 2007 (EP) ..... 07114542

(51) Int. Cl.
*E02B 17/08* (2006.01)
*B63B 21/00* (2006.01)

(52) U.S. Cl.
USPC ..... 405/203; 405/223.1

(58) Field of Classification Search
USPC ..... 405/203, 223, 223.1, 224
See application file for complete search history.

(56) References Cited

U.S. PATENT DOCUMENTS 4,943,188 A 7/1990 Peppel
6,352,116 B1 * 3/2002 Børseth ..... 166/359
6,409,428 B1 6/2002 Moog
7,044,685 B2 5/2006 Wybro et al.
2003/0000447 A1 1/2003 Fontenot et al.
2004/0190999 A1 * 9/2004 Wybro et al. ..... 405/203

FOREIGN PATENT DOCUMENTS

FR 2 791 316 9/2000
WO 03/004347 1/2003
WO 2004/055394 7/2004
WO 2004/079146 9/2004

OTHER PUBLICATIONS

International Search Report dated Nov. 24, 2008, from corresponding PCT application.

* cited by examiner

*Primary Examiner* — David Bagnell
*Assistant Examiner* — Kyle Armstrong
(74) *Attorney, Agent, or Firm* — Young & Thompson

(57) ABSTRACT

Floating construction (1) having a base (2), a tensioning member (17, 18) extending from the sea bed in the direction of the base, a connector (27, 28) at an upper end (16,19) of the tensioning member and attachment means on the base for attaching to the connector, characterized in that, the attachment means comprise a guide member (14, 15) for lowering a tensioning member (12, 13) section by a predetermined distance (D2), which tensioning member section at a free end (23, 24) is provided with a complementary connector (25, 26) for attaching to the connector on the upper end of the tensioning member, the tensioning member section comprising at an upper end a stopper (31, 32) for engaging with the base and for fixing and/or adjusting the upper end in a vertical direction, the floating construction comprising a pulling device (36, 37, 38, 39) attached to the tensioning member section, for lowering the tensioning member section along the guide member towards the tensioning member.

17 Claims, 4 Drawing Sheets

TENSION LEG CONNECTION SYSTEM AND METHOD

BACKGROUND OF THE INVENTION

1. Field of the Invention

Figure 1:
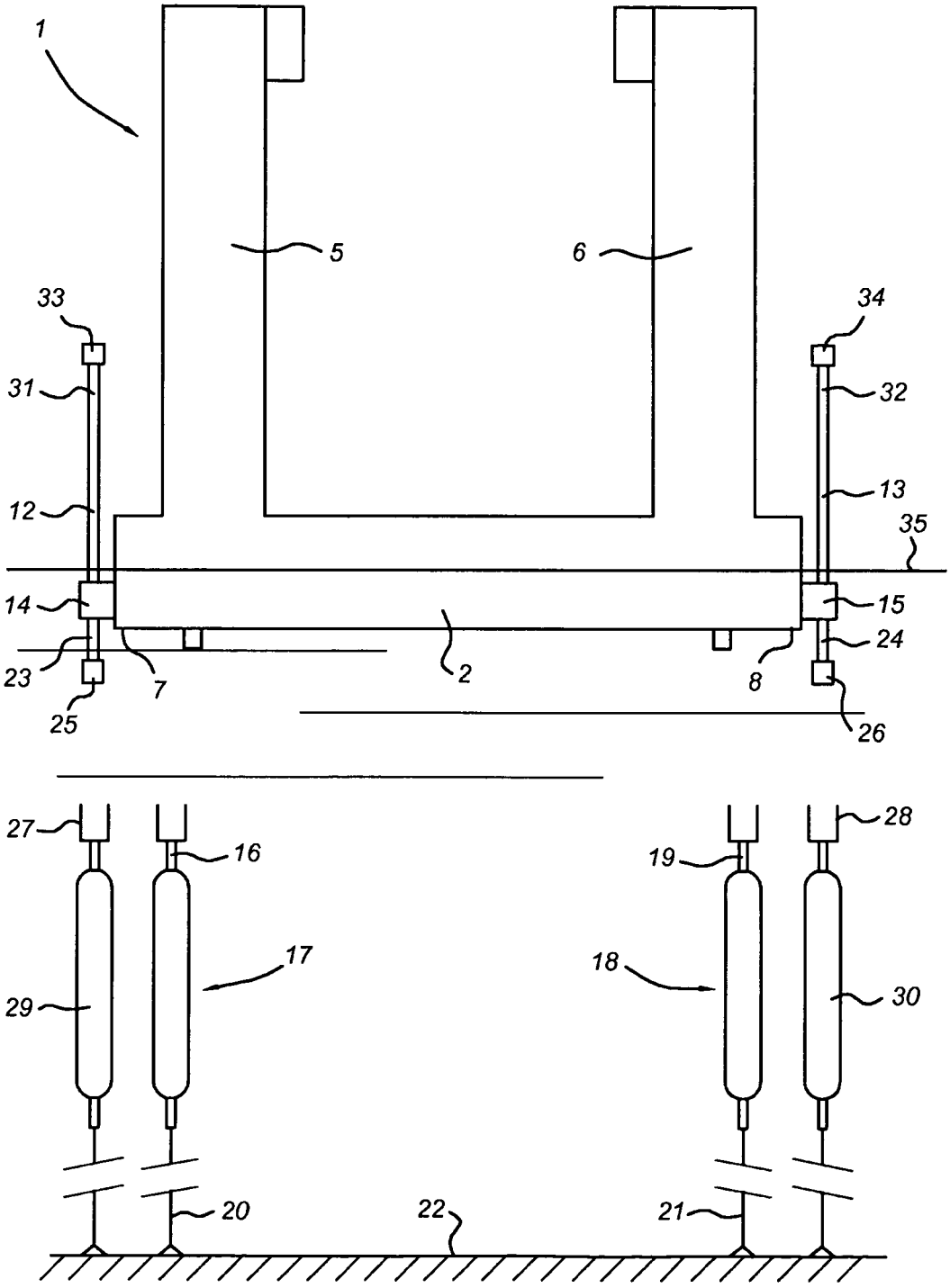

The invention relates to a floating construction having a base, a tensioning member extending from the sea bed in the direction of the base, a connector at an upper end of the tensioning member and attachment means on the base for attaching to the connector.

2. Description of the Related Art

Tension leg platforms (TLP's) that are anchored to the sea bed via taut tendons or tension legs are generally known. For installation of the platform, which is often formed by a semi-submersible structure, the hull is towed to the installation site without its top structure attached. The hull of the semi-submersible structure is anchored to the sea bed via pre-installed tendons. The normal installation procedure of a TLP requires the platform to be connected to the pre-installed tension legs. For this, the TLP is towed to its final mooring position, after which the TLP is ballasted down to its lock-off off draft (the draft at which a connection with the tension legs is made). The upper ends of the tension legs are then aligned with connection sleeves of the TLP hull, after which the tension legs can be clamped to gain a permanent connection. Finally, the TLP may be de-ballasted such that the TLP gains its operating draft and the tendons are tensioned.

When the TLP is in lock-off draft, the hull needs to be positioned precisely in line with the tension leg connection points, before the final connection can be made. The installation procedure not only requires precision at this point, but since the stability of the TLP may also be inadequate due to its reduced water-surface penetrating area, it also requires methods for providing stability during installation.

There are several ways to make a TLP more stable during installation. For example, a wider hull base may be used to increase the stability of the TLP, or the deck may be installed offshore after the hull is permanently moored. Offshore installation can only be done in good weather and it is expensive and dangerous. Another method to increase the stability during installation relies on the use of specialized installation equipment such as installation support vessels or temporary buoyancy vessels. Since there are only a small number of vessels capable of providing the required stability, this method is also costly.

U.S. Pat. No. 7,044,685 describes a method for installing a TLP by connection to its tendons using pull-down lines to rapidly submerge the hull to installation draft while compensating for inherent hull instability during submergence. The system includes tensioning devices mounted on the TLP, usually one for each tendon and clamping connection sleeves on each corner of the hull for attaching to the upper end of the tendons. The TLP is submerged to lock-off draft by applying a tensioning force to the pull-down lines connected to the top of the tendons. Additionally, the hull may be ballasted to aid in submerging the TLP. The TLP is then positioned such that the upper ends of the tension legs can be fixed inside the connection sleeves.

The above mentioned installation procedure provides improved stability during installation, since it provides a downward force at the various connection points. In this way, it is not possible for the unstable hull to capsize, since this requires that one side of the hull rotates upward. The downward force provided by the tensioning devices prevents this from happening.

The known connection of the upper ends of the tendons to the hull causes relatively large bending forces that are exerted on the releasable connection of the sleeves. Furthermore, the known method of connection of the upper ends of the tendons to the hull has as a drawback that the tendons must be accurately aligned with the connection sleeves, which requires positioning of the hull by the installation support vessel. All the different tension lines must be reeled in at a correct position, before said connection can be made. This is a time consuming task and requires a large degree of precision. The use of remote operating vehicles (ROV) is required to check whether each tension leg is in a correct connection position.

SUMMARY OF THE INVENTION

It is therefore an object of the present invention to provide a floating construction and a method of connection such a construction to tension legs, which avoids large bending forces on the connector and which can be rapidly anchored to the sea bed via pre-installed tension legs without the need for installation support vessels. It is a further object to provide a floating construction which needs only be positioned with a relatively small degree of accuracy in order to obtain a proper connection.

Hereto the floating construction according to the present invention is characterised in that the attachment means comprise a guide member for lowering a tensioning member section by a predetermined length, which tensioning member section at a free end is provided with a complementary connector for attaching to the connector on the upper end of the tensioning member, the tensioning member section comprising at an upper end a stopper for engaging with the base and for fixing the upper end in a vertical direction, the floating construction comprising a pulling device attached to the tensioning member section, for lowering the uncoupled tensioning member section along the guide member.

By placing the complementary connection members on tendon segments which can be lowered from the floating vessel along the guide members towards the connectors on the pre-installed tendons, it is no longer needed to pull in the tendons prior to connection to the hull. Firstly, the connection of the pre-installed tendon with the tendon section is made in a low-tension configuration. Only after the connection has been made, the tendon section is pulled in to tension the complete tendon assembly. The connectors remain submerged below the base of the floating structure, such that bending forces remain low and can be taken up in the tendon section that extends between the connectors and the hull.

The guiding members or the stoppers can also be provided with a pivoting point such as flex joint or a uni-joint. The complementary connector will hence be located below the pivoting point.

The distance of the complementary connectors from the hull can be between 1 m and 200 m, preferably between 5 m and 50 m. By placing the connectors at a relatively large distance below the hull, bending forces can be properly kept within reduced limits. Furthermore, it is advantageous to lower the connectors to a position below the wave active zone in order to keep the forces on the connectors at a low level.

In one embodiment, the upper tendon section is flexible. In this way, the upper tendon section can be easily orientated during the connection to the lower tendon part, for instance by a guide wire or remote operated vehicle (ROV). The upper tendon section can be made of steel cable, steel or synthetic wire rope or combinations thereof.

In one embodiment, the pulling device comprises a winch on the floating construction and a cable extending from the winch to the top of the tensioning member section. In this way a simple means for lowering the connecting tendon sections is achieved.

Preferably the pulling device is adapted for upward pulling of the attached tensioning member for exerting a tensioning force on the tensioning member. Such pulling devices may comprise a winch, ratchets, hydraulic jacks, and the like.

The top of the tensioning members may be provided with buoyancy means keeping the tensioning member in a substantially vertical position, a guide wire extending from the top of the tensioning member to the lower end of the tensioning member section. Along the guide wire, the upper tendon segment with the complementary connector may be effectively guided towards the connector at the top of the tendon, which is held by the buoyancy into a properly defined connection orientation.

BRIEF DESCRIPTION OF THE DRAWING FIGURES

Figure 2:
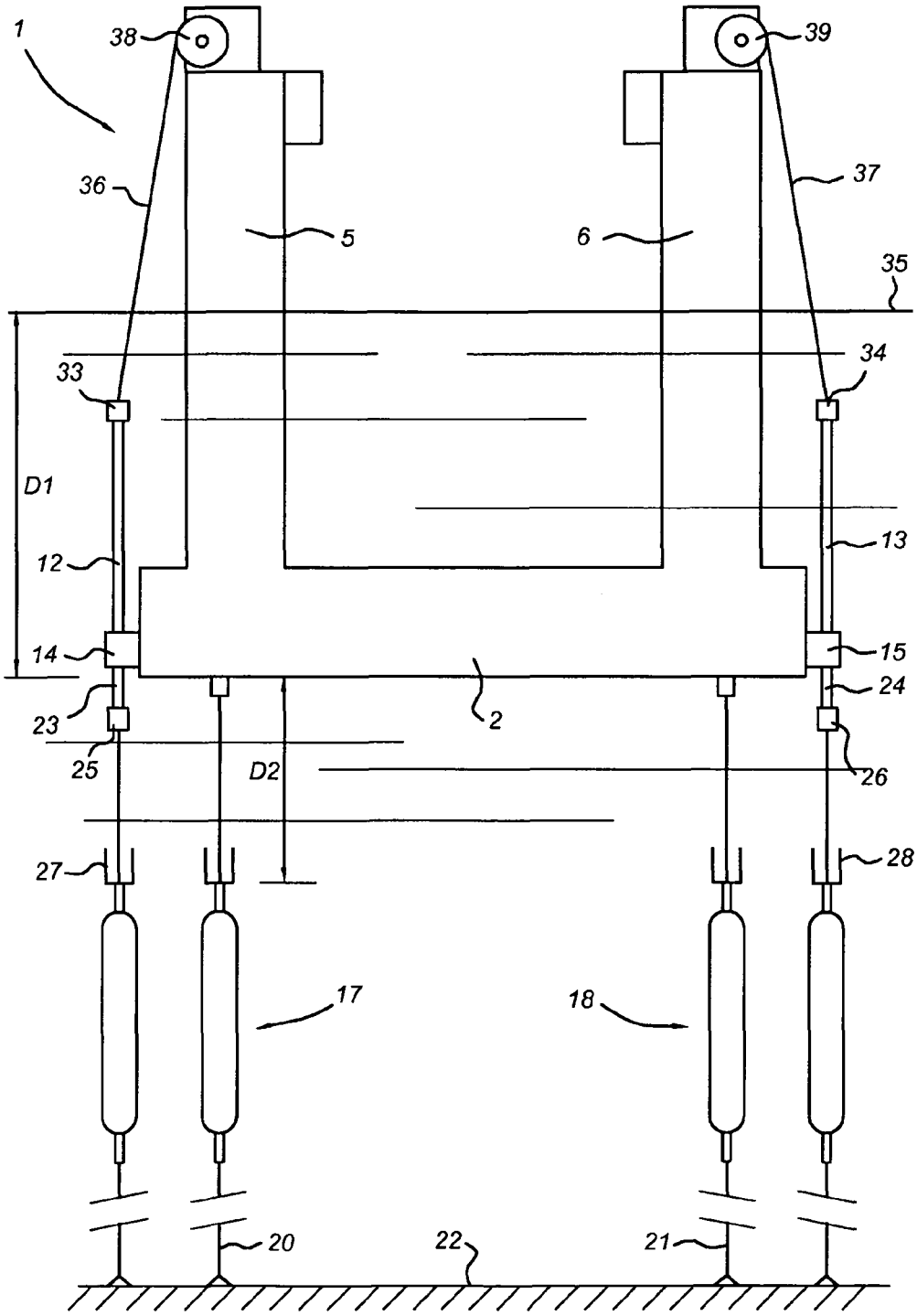
Figure 3:
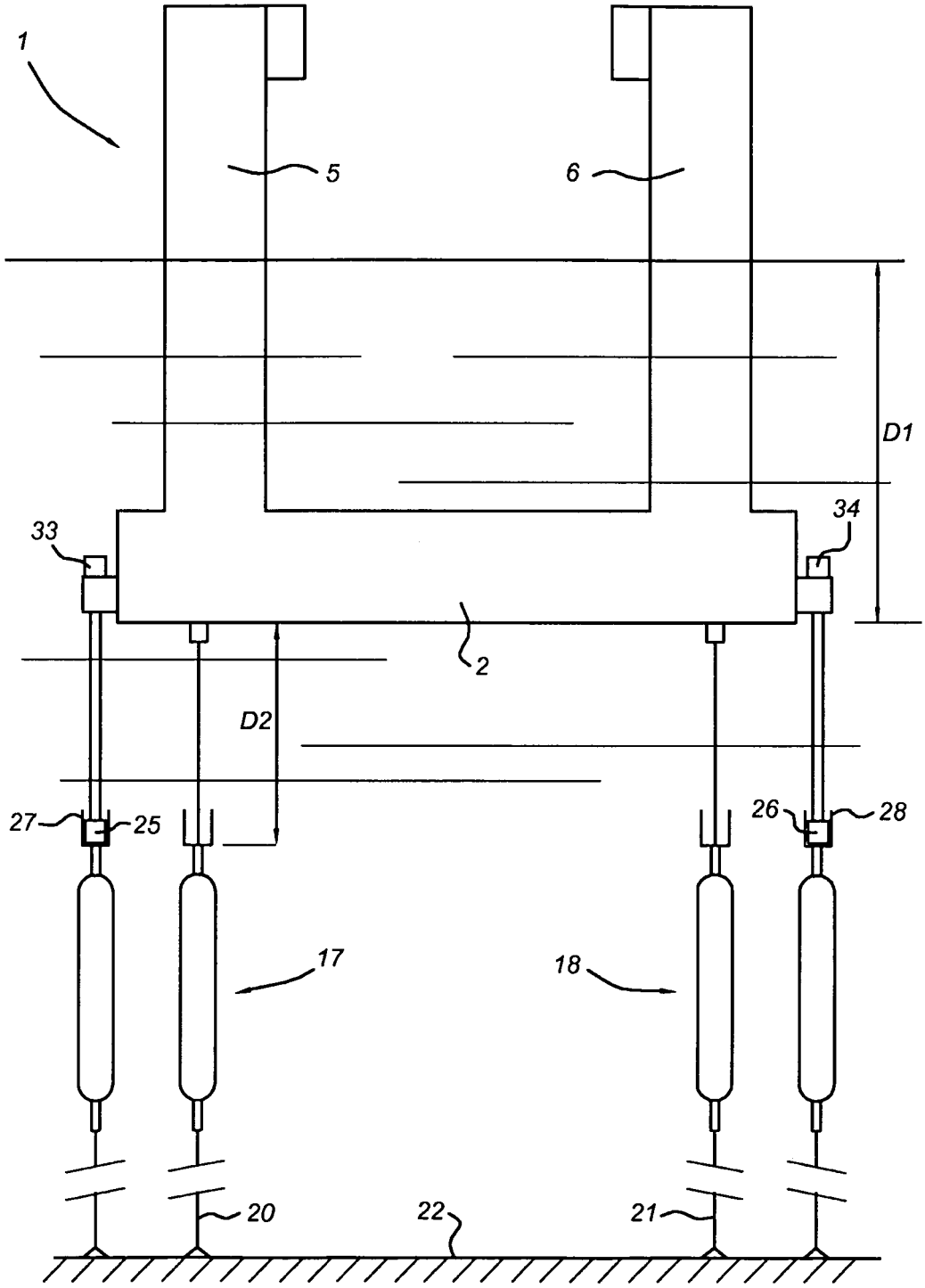
Figure 4:
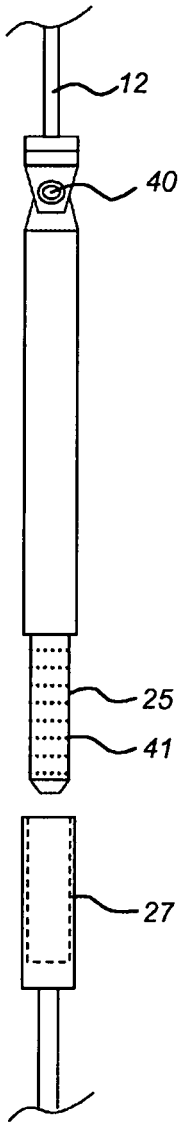
Figure 5:
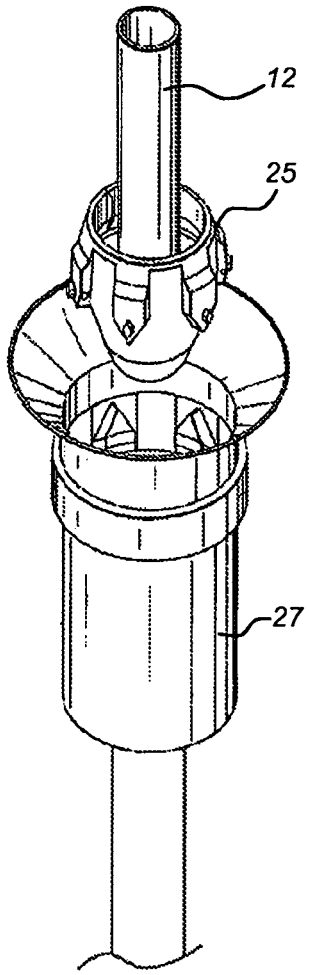

An embodiment of a floating construction comprising the tendons according to the present invention will, by way of example, be explained in detail with reference to the accompanying drawings. In the drawings:

FIG. 1 shows a schematic side view of a TLP according to the present invention with the connecting tendon segments in a retracted position, FIG. 2 shows the TLP of FIG. 1 with the connecting tendon segments attached to the lower tendons via a guide wire, prior to connection, and FIG. 3 shows the TLP of FIG. 1 with the upper tendon segments and the lower tendons connected, FIG. 4 shows a first embodiment of a connector suitable for use with the tensioning system of the present invention, and FIG. 5 shows a second embodiment of a connector suitable for use with the tensioning system of the present invention, and

DETAILED DESCRIPTION OF THE INVENTION

FIG. 1 shows a tension leg platform 1 with a base comprising a hull 2 and with four support columns 5, 6 to which super structure carrying exploration and/or processing equipment may be attached. The hull 2 is floating at the water surface and the TLP is towed to its installation site in this position. At the corners 7, 8 of the hull 2 tendon sections 12, 13 are supported in guide sleeves 14, 15 to be lowered and raised, respectively, towards and away from vertically oriented pre-installed tendons 17, 18 that with their lower ends 20, 21 are attached to the sea bed 22.

Each tendon section 12, 13 is at an upper end 31, 32 provided with a stop member 33, 34 for engaging with the guide sleeves 14, 15 to vertically fix the position of each tendon section 12, 13. Each tendon section 12, 13 is at a lower free end 23, 24 provided with a connector 25, 26, such an hydraulically or mechanically operated male or female connector, which can engage with a complementary connector 27, 28 at the end of each pre-installed tendon 17, 18. Each tendon 17, 18 is kept in a vertical orientation by an upward force exerted on the tendon via buoyancy members 29, 30 at their upper ends 16, 19.

FIG. 2 shows the TLP 1 in a ballasted state in which the hull 2 is submerged below sea level 35 by a depth D1 of for instance 30 m or 100 m or more (150 m) for a deep draft TLP. The upper ends 33, 34 are attached to a cable 36, 37, wherein each cable is connected to an individual winch 38, 39. The lower ends 23,24 of tendon section 12, 13 are attached to a guide wire 40, 41, one end of which is attached to the upper end 16,19 of a respective tendon 17, 18 by divers or by ROV. Next, the tendon sections 12, 13 are lowered over a length D2 of 1 m-200 m, preferably 5-50 m by driving the winches 38, 39 and paying out the cables 36, 37 such that the tendon sections 12, 13 slide downwardly along the guide sleeves 14, 15 and the connectors 25, 26 follow the guide wires 40, 41 until they reach the complementary connectors 27, 28. After mating of the connectors 25, 27 and 26, 28, the tendons 17, 18 may be tensioned by either deballasting the hull 2, or by pulling the tendons upward via winches 38, 39, or both. After tensioning of the tendons, the cables 36, 37 may be detached, as shown in FIG. 3 and the stop members 33, 34 engage with the guide sleeves 14, 15.

FIG. 4. Shows a known connection 25, 27 for use in the tensioning system in which the connector 25 is attached in a pivot point to the tendon section 12. The rod-shaped pivot point 40 to the tendon section 12. The rod-shaped connector 25 comprises projections 41 on its outer surface which lock into recesses on the receiving sleeve of complementary connector 27 upon insertion of the connector rod therein. The connector 25, 27 of FIG. 4 is described in detail in WO 2004/055394.

FIG. 5. shows an alternative connector 25, 27 in which a conical head of connector 25 is locked into a tapering receiving sleeve of complementary connector 27. The connector 25, 27 of FIG. 5 is described in detail in U.S. Pat. No. 4,943,188.

The invention claimed is:

1. A floating construction (1), comprising:

a base (2);

a tendon (17, 18) extending from a sea bed in a direction of the base;

a connector (27, 28) at an upper end (16, 19) of the tendon;

means for attachment (12, 13, 14, 15, 25, 26, 33, 34) on the base for attaching to the connector (27, 28), the means for attachment comprising a guide member (14, 15) for lowering a tendon section (12, 13) by a predetermined distance (D2) below a bottom of the base (2), the distance (D2) in a moored state of the floating construction being between 1 m and 200 m, the tendon section (12, 13) at a free end (23, 24) being provided with a complementary connector (25, 26) for attaching to the connector (27, 28) on an upper end (16, 19) of the tendon (17, 18), the tendon section comprising at an upper end (31, 32) a stopper (33, 34) for engaging with the guide member (14, 15) and for tensioning the tendons (17,18) upon deballasting of the base (2), whereby the upper end (31, 32) of the tendon section is fixed in a vertical direction and a lower end of the tendon section (12,13) extends substantially in line with the tendon (17, 18) while the complementary connector (25, 26) is situated at a distance (D2) below the bottom of the base; and a pulling device (36, 37, 38, 39) attached to the tendon section (12, 13), for lowering the tendon section (12, 13) along the guide member (14, 15) towards the tendon (17, 18), the pulling device comprising a winch (38, 39) on the floating construction and a cable (36, 37) extending from the winch to the upper end (31, 32) of the tendon section (12, 13).

2. The floating construction (1) according to claim 1, wherein the guide members (14, 15) or the means for attachment (12, 13, 14, 15, 25, 26, 33, 34) are provided with a pivoting point.

3. The floating construction (1) according to claim 2, wherein the complementary connector (25, 26) is placed below the pivoting point.

4. The floating construction (1) according to claim 1, wherein the distance (D2) is between 5 m and 50 m.

5. The floating construction (1) according to claim 1, wherein the tendon section (12, 13) is flexible.

6. The floating construction (1) according to claim 1, wherein the pulling device (36, 37, 38, 39) is adapted for upward pulling of the attached tendon section (12, 13) for exerting an upward tensioning force on the tendon.

7. The floating construction (1) according to claim 1, the upper end (16, 19) of the tendon (17, 18) comprising means for buoyancy (29, 30) keeping the tendon (17, 18) in a substantially vertical position, a guide wire (40, 41) extending from the connector (27, 28) at the tendon to the lower end (23, 24) of the tendon section (12, 13).

8. A method of connecting a floating structure comprising a base (2) to pre-installed vertically oriented tendons (17, 18) having upper ends submerged a pre-determined distance (D2) below sea level, comprising:

floating a construction to an installation site;

lowering a tendon section by the predetermined distance (D2) below a bottom of the base (2), substantially in line with the respective pre-installed tendon (17,18), along a guide member on a base, towards an upper end of the pre-installed tendon which at an upper end of the respective pre-installed tendon is provided with a connector, via a pulling device on the floating structure that is attached to the tendon section and via a guide wire or ROV attached to the tendon section, the pulling device comprising a winch on the floating construction and a cable extending from the winch to the upper end of the tendon section;

connecting the connector at the upper end of the tendon with a complementary connector at a lower end of the tendon section via the guide wire or ROV;

engaging a stopper at an upper end of the tendon section with the guide member and fixing the upper end in a vertical direction; and exerting a tensioning force on the tendons by deballasting the base, wherein the distance (D2) in a moored state of the floating construction is between 1 m and 200 m.

9. The method according to claim 8, wherein the complementary connector is lowered along a guide wire attached to the connector of the tendon.

10. The method according to claim 8, wherein the distance (D2) is between 5 m and 50 m.

11. A floating construction, comprising:

a base;

a tendon extending from a sea bed in a direction of the base;

a connector at an upper end of the tendon;

an attachment device on the base for attaching to the connector, the attachment device comprising a guide member for lowering a tendon section by a predetermined distance below a bottom of the base, the distance in a moored state of the floating construction being between 1 m and 200 m, and at a free end being provided with a complementary connector for attaching to the connector on an upper end of the tendon, the tendon section comprising at an upper end a stopper for engaging with the guide member and for tensioning the tendon upon deballasting of the base, whereby the upper end of the tendon section is fixed in a vertical direction and a lower end of the tendon section extends substantially in line with the tendon while the complementary connector is situated at the distance below the bottom; and a pulling device attached to the tendon section, for lowering the tendon section along the guide member towards the tendon, the pulling device comprising a winch on the floating construction and a cable extending from the winch to the upper end of the tendon section.

12. The floating construction according to claim 11, wherein the guide members or the attachment device are provided with a pivoting point.

13. The floating construction according to claim 12, wherein the complementary connector is placed below the pivoting point.

14. The floating construction according to claim 11, wherein the distance is between 5 m and 50 m.

15. The floating construction according to claim 11, wherein the tendon section is flexible.

16. The floating construction according to claim 11, wherein the pulling device is adapted for upward pulling of the attached tendon section for exerting an upward tensioning force on the tendon.

17. The floating construction according to claim 11, wherein the upper end of the tendon comprises a buoyancy device keeping the tendon in a substantially vertical position, a guide wire extending from the connector at the tendon to the lower end of the tendon section.

* * * * *